US005520075A

United States Patent [19]

Barmore

[11] Patent Number: 5,520,075

[45] Date of Patent: May 28, 1996

[54] SOCKET WRENCH SET AND FASTENER

[76] Inventor: Thomas C. Barmore, 4 N. 127 Verrill, Addison, Ill. 60101

[21] Appl. No.: 711,958

[22] Filed: Jun. 7, 1991

[51] Int. Cl.[6] ..... B25B 15/00

[52] U.S. Cl. ..... 81/437; 81/451; 81/438

[58] Field of Search ..... 81/121.1, 124.4, 81/124.6, 437, 438, 451

[56] References Cited

U.S. PATENT DOCUMENTS 3,878,740 4/1975 Gutshall ..... 81/124.6
4,242,932 1/1981 Barmore ..... 81/437
4,466,315 8/1984 Boschetto et al. ..... 81/437
4,982,632 1/1991 Barmore ..... 81/438

*Primary Examiner*—James G. Smith
*Attorney, Agent, or Firm*—Paul H. Gallagher

[57] ABSTRACT

A one-piece socket having a hole therethrough with a rear recess for receiving the shaft of a driver tool, and a front recess for receiving the head of the workpiece (bolt) to be worked on. The hole includes a small segment for securing a key therein, the key being adjustable to extend into the front recess, and therebeyond to the exterior, selectively. The front recess engages convex surfaces on the workpiece and the key engages concave surfaces thereon. In an alternate form, the key is fixed and extends only into the recess.

11 Claims, 1 Drawing Sheet

SOCKET WRENCH SET AND FASTENER

BRIEF SUMMARY OF THE INVENTION

The invention resides in the field of socket wrenches, or socket wrench sets. Such sets, broadly, are known. A set may include one or more sockets, and in certain cases it may include other elements to be used in, or with, or in conjunction with the socket.

Socket wrenches are ordinarily produced in sets, having for example a plurality of socket members proper, of different sizes, or a single socket member with other elements of different sizes or other characteristics.

1. Cross References

My prior patents:

U.S. Pat. No. 4,242,932 dated Jan. 6, 1981

U.S. Pat. No. 4,982,632 dated Jan. 8, 1991

2. Objects of the Invention

The principal object of the invention is to produce a socket for use with a wrench as in a set, having the following features and advantages:

1. The device is a simple tool for engaging a workpiece (bolt) selectively on an external surface, or internal surface, or both.
2. The device is simple, not only in its use, but in its production and is correspondingly inexpensive.
3. The device is used with presently known socket wrench sets for use with standard workpieces.

DETAILED DESCRIPTION

Referring to the invention in general, it is pointed out that the socket of the invention is particularly adapted for engaging external surfaces of a workpiece, and internal surfaces, selectively, this being accomplished by a single socket of extremely simple construction.

Figure 1:
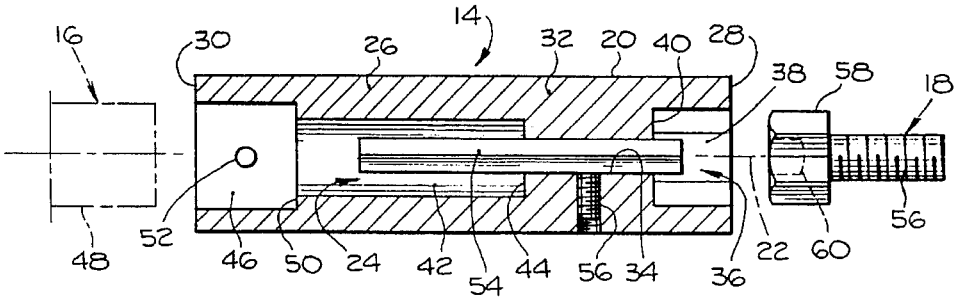
FIG. 1 is a longitudinal section of the socket having the features of the invention, shown in conjunction with a driver and a workpiece.

Referring in detail to the drawings, FIG. 1 shows the socket of the invention together with a driver and a workpiece. The socket itself is shown at 14, the driver indicated at 16 and the workpiece shown at 18. The socket includes a socket member 20 usually referred to in the trade simply as a socket, and it is so referred to herein at times. The socket member 20 is elongated, and may have a cylindrical outer surface, the central longitudinal axis of the socket member being indicated at 22. The socket member has a longitudinal main hole 24 therethrough which is made up of a series of segments (four) as will be referred to again hereinbelow.

The socket member 20 is a one-piece, integral member, of hardened steel, or cast alloy, having a body referred to for convenience as a shell. The socket, for convenience, is referred to as having a front end 28 and a rear end 30.

The shell 26 includes a body portion 32 extending radially inwardly to form a small hole 34 as a segment of the main hole. The main hole also includes a segment forming a front recess 36 having an inner polygonal surface 38, e.g. hexagonal, forming a forwardly-facing shoulder 40.

Rearwardly of the body portion 32 is another segment 42 of the main hole, located generally centrally of the socket. The body portion 32 forms a rearwardly facing shoulder 44.

Rearwardly of the hole segment 42 and constituting another segment of the main hole is a rear recess 46 of polygonal cross-sectional shape, such as square, for receiving the driving shaft 48 of a drive tool 16. The segment 46 of the hole has at least portions larger than the segment 42, forming a rearwardly facing shoulder 50. A conventional means indicated at 52 is provided for releasably holding the drive shaft 48 in the recess.

Positioned in the small hole 34 is a key or pin or inner drive element 54 which is held in place, in this case (FIG. 1), by a set screw 56 in a transverse hole in the body portion 32, engaging the key for releasably holding the key in adjusted position. The small hole 34 and the key 54 are of the same polygonal shape and size for producing a turning movement on the key.

The workpiece 18 may be any of a plurality of different members, in the present case being a bolt having a threaded shank 56 and a head 58. The head has a polygonal external surface, in this case hexagonal, of the same size as the front recess 36. In the present case the head 58 is provided with a cavity 60 in its end surface, which is polygonal in shape also, hexagonal, dimensioned to fit the polygonal key 54. The bolt may also be referred to as a fastener which broadly includes bolts, screws, etc.

In the use of the socket with the workpiece 18 as just described, the socket is operable for engaging both external and internal surfaces on the workpiece, namely, the external polygonal surface of the head and the internal polygonal surface of the cavity. The key 54 is adjustable longitudinally in the socket member and held in adjusted position by the set screw 56, as noted above, and for using the socket on a workpiece 18 of the kind just referred to, the key is adjusted to the position shown in FIG. 1 where the front end thereof extends a short way into the front recess 36. When the socket is applied to the workpiece, the head 58 is telescoped into the front recess, and the front end of the key into the cavity 60. The dimensions are such that preferably the head 58 engages the shoulder 40 providing additional stability in this step.

Figure 2:
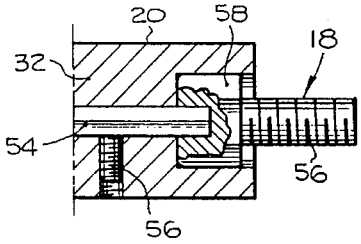
FIG. 2 is a view similar to the right-hand portion of FIG. 1 with the workpiece in position in the socket.

To turn the workpiece, the power tool 16 is operated, turning the socket, and the engagement with the workpiece is both external and internal, providing great torque effect and eliminating or greatly minimizing tendency to misshape the head of the workpiece. FIG. 2 clearly brings out this relationship.

Figure 3:
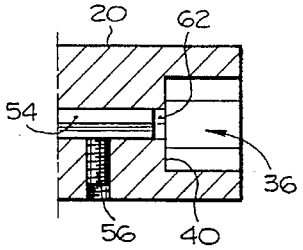
FIG. 3 is a view similar to the right-hand portion of FIG. 1 but showing the key, or drive element, in an inwardly adjusted position.

The adjustability of the key in longitudinal direction, provides greater flexibility in the use of the tool. In the case of a workpiece having a head (58) without a cavity, the key is retracted to an inner position shown in FIG. 3 where the front end is backed off from the front recess, as indicated at 61, enabling the head of the workpiece to engage the shoulder 40. In this case, the key is held in the retracted position by the set screw, and thereby stored. The key may be placed further back than the position indicated, if desired. The same effect is produced by even removing the key, if that should be desired. The key 54 may be provided with a head on its inner or rear end to prevent its accidentally falling out in forward direction.

Figure 4:
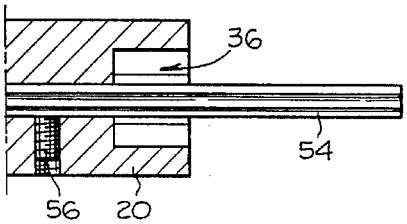
FIG. 4 is a view similar to FIG. 3 but with the key in outwardly extended position.

FIG. 4 represents the use of the tool for engaging an internal surface of the workpiece, in this case the key 54 being extended forwardly through the front recess and to an appropriate extent forwardly. The key can then be inserted into a cavity in the workpiece which may otherwise be inaccessible. In this instance only the internal surface of the workpiece is engaged, but this represents the selectivity of the use of the tool relative to both external and internal surfaces.

Figure 5:
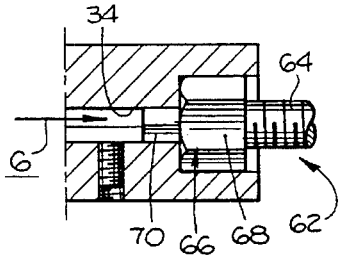
FIG. 5 is a sectional view of the right-hand portion of the socket but with the key removed and the two-level head of a workpiece inserted in the socket.

FIG. 5 shows another adaptation of the use of the device. In this case a workpiece is shown at 62, which has a threaded shank 64 and a head 66. This head is of two-level kind, having a large element 68 forming a lower level, and a small element 70 forming an upper level, referred to also for convenience as lower and upper elements, both of which have polygonal, such as hexagonal, external surfaces. In applying the tool to this workpiece, the key 54 is removed, and the head is telescoped into the recess with the lower large element in the recess proper, and the upper small element 70 extended into the small hole 34. Both of the external surfaces on the head, i.e. large and small elements, are engaged, providing greater gripping effect in the turning operation. It is within the scope of the invention, that instead of removing the key in this case (FIG. 5), it can be retracted to a position farther back, as noted, to enable the small element of the head to enter fully into the small hole. The hole for the set screw 56 may be positioned farther back than that shown (FIG. 1) if desired. As used herein, the terms retracted and removed may be considered equivalent as concerns the key 54 in its relation to the front recess.

Figure 6:
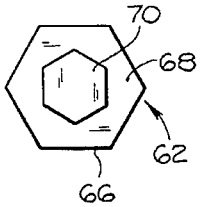
FIG. 6 is an end view of the work piece in FIG. 5 oriented according to the arrow 6 of the latter figure.

Many bolts, constituting the workpieces, are provided with hex heads, and the cavity 60 and key 54 are of that same shape. FIG. 6 shows the workpiece 62 having the hex head referred to. In this shape of head, it is usually desirable that the large and small elements be relatively angularly displaced, with a corner of one in register with a flat side of the other.

Figure 7:
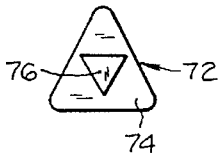
FIG. 7 is an end view similar to FIG. 6 but showing a different shaped workpiece.
Figure 8:
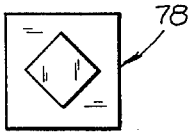
FIG. 8 is a view similar to FIGS. 6 and 7 showing still a different shaped workpiece.
Figure 9:
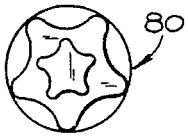
FIG. 9 is a view similar to FIGS. 6–8 of still another workpiece.

FIGS. 7–9 show other shapes of workpiece heads. In FIG. 7 the head 72 is triangular in shape, with the lower large portion 74 and the upper small portion 76 angularly displaced as referred to in connection with FIG. 6. In FIG. 8 the head has square lower and upper elements and in FIG. 9 the head 80 is star-shaped, this form being known as the "Torx" head. While the head of FIG. 9 is generally star-shaped, it may be considered polygonal, in a broad sense, in that it is non-circular and the elements thereof engage corresponding elements in the socket, for turning the workpiece, and the term polygonal, as used herein, is intended to cover this form also.

Figure 10:
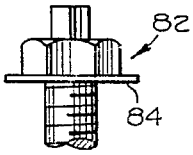
FIG. 10 is a side view of the head of a workpiece of another form.

The tool is adapted for use with other forms of workpieces, such as one having a head shown in FIG. 10. In this instance the head 82 has a lower large element and an upper small element as in the case of FIG. 5, but it includes a washer 84 as a part of the lower element. In applying the tool to this kind of workpiece, the socket engages the washer, thus limiting the extent of the movement of the head into the recess.

Figure 11:
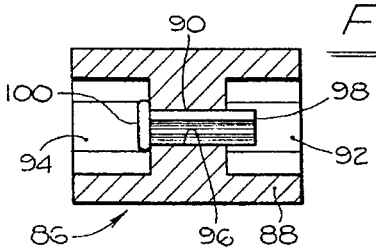
FIG. 11 is a longitudinal sectional view of a modified form of socket.

The form of workpiece 18, shown in FIG. 1, is often utilized in great numbers, and in such case, it may be convenient to have a socket with the key therein in fixed position. FIG. 11 shows a modified form, of this kind including a socket member 88 of one-piece construction. It has a radially inwardly extending body portion 90 forming a front recess 92 and a rear recess 94. Formed in the body portion 90 is a small hole 96 in which a key 98 is press fitted, the key having a head 100 engaging the shoulder in the rear recess for limiting its forward movement. The elements are so dimensioned that the key extends into the front recess 92 a short distance, and when the socket is applied to the workpiece 18, the head 58 fits into, and fills, the front recess while the key enters the cavity in the head. It is also within the scope of the invention to make the key and the socket member of one-piece construction.

In the case of both sockets, i.e. FIG. 1 and FIG. 11, the socket member is a one-piece, integral element and the key is fitted in a hole in the socket member, and the key engages the material making up the shell of the socket member. Thus the small hole in which the key is fitted, determines the position of the key, to the exclusion of any other mounting means. The key is held in its determined position in the case of FIG. 1 by the set screw, and in the case of FIG. 11 by friction.

I claim:

1. A socket for use in a socket wrench set, the socket having a front end and a rear end and a longitudinal main hole therethrough, forming a shell, the socket having a radially inwardly extending body portion defining a front recess as a segment of the hole opening to the exterior, said body portion also defining a small hole forming a segment of the main hole and thereby opening into the front recess, the front recess having a polygonal internal surface adapted to receive and engage a corresponding external surface on a workpiece for turning the workpiece about a longitudinal axis, and the socket including a key having an external polygonal surface adjustably secured in the small hole and extendable into the front recess and adapted to extend into a corresponding internal surface in a workpiece for turning the workpiece about a longitudinal axis, the key being adjustable through the front recess to a position forwardly of the shell for engagement with a workpiece independently of the front socket.

2. A socket according to claim 1 wherein, the key is provided with a head to prevent it from falling out forwardly.

3. A socket for use in a socket wrench set, the socket having a front end and a rear end and a longitudinal main hole therethrough, forming a shell, the socket having a radially inwardly extending body portion defining a front recess as a segment of the hole opening to the exterior, said body portion also defining a small hole forming a segment of the main hole and thereby opening into the front recess, the front recess having a polygonal internal surface adapted to receive and engage a corresponding external surface on a workpiece for turning the workpiece about a longitudinal axis, and the socket including a key having an external polygonal surface adjustably secured in the small hole and extendable into the front recess and adapted to extend into a corresponding internal surface in a workpiece for turning the workpiece about a longitudinal axis, the key being retractable rearwardly, thereby enabling the front recess to receive a workpiece and whereby the front recess can constitute the sole means engaging the workpiece for turning it.

4. A socket for use in a socket wrench set for turning a workpiece having a head of any of the following three kinds:

(a) a single level including a large element having an external polygonal surface, (b) the kind as in (a) with a cavity having an internal polygonal surface, (c) two levels including a lower large element having an external polygonal surface, and an upper small element having an external polygonal surface, all of said polygonal surfaces being of predetermined sizes respectively, the socket having a front end and a rear end, and a longitudinal main hole extending therethrough, forming a shell, the socket having a radially inwardly extending body portion defining a front recess in the hole opening to the exterior, said body portion also defining a small hole forming a segment of the main hole and thereby opening into the front recess, the small hole having an internal polygonal surface, the socket including a key having an external polygonal surface cooperable with the internal polygonal surface of the small hole, and the key being removably secured in the small hole, and longitudinally adjustably so secured, the socket being adapted for receiving in the front recess the large element of the head as in kind (a), the key when extended into the front recess being extended into the cavity as in kind (b), the socket being adapted, in the case of kind (c), when the key is retracted in the small hole, for receiving the small element of the head in the small hole, the key being adjustably extendable through the front recess to the exterior, and the socket, when the key is so extended, being adapted for insertion of the key in a cavity of kind (b), the polygonal surfaces being dimensioned for operably fitting to and producing a turning force on the associated polygonal surfaces of the workpieces respectively.

5. A socket according to claim 4 wherein, the socket member has a longitudinal main hole therethrough, thereby forming a surrounding shell, the surrounding shell is of one piece, the socket includes as segments of the main hole, said front recess and a small hole rearwardly thereof, a key separate from the shell is secured in the main hole and has a front end portion extending into the front recess, said front end portion constituting said key element, the key directly engaging the material of the shall and its position determined thereby, to the exclusion of other mounting means.

6. A socket for use in a wrench set, wherein the socket includes a socket member having a front end and a rear end, the socket member has a front recess and a rear recess, the socket includes a central element having a front end extending from the rear of the front recess forwardly into that recess and form a key element therein, the front recess and key element have respectively an internal polygonal surface, and an external polygonal surface, said polygonal surfaces are adapted to operably engage corresponding polygonal surfaces in a workpiece for turning the workpiece, the socket member has a small hole communicating with and leading rearwardly from the front recess, and the key element is press fitted in the small hole and thereby held in position by friction against longitudinal shifting from that position.

7. A socket for use in a socket wrench set and for use on a workpiece including a head having a large element forming a large external socket-engaging surface and a small turning-force receiving surface, the socket including a socket member of one piece and having a front end and a rear end and a longitudinal main hole therethrough, forming a shell, the socket member having a radially inwardly extending body portion defining a front recess as a segment of the hole and having a rear end opening to the exterior, the entire internal peripheral surface of the front recess being polygonal and the front recess being adapted to receive and engage the large external socket-engaging surface on the head, for producing a turning force on the workpiece about a longitudinal axis, the socket also having an adjustable means adjacent the rear end of the front recess operably engaging said small turning-force receiving surface for also providing a turning force on the workpiece about a longitudinal axis.

8. A socket according to claim 7 for use with a workpiece having a head made of levels including a lower large element and an upper small element, both having external polygonal surfaces, wherein, the upper small element constitutes said small turning-force receiving surface, the inwardly extending body portion also defining a small portion of the hole rearwardly of the front recess, the socket and workpiece being adapted for insertion of the head into the front recess, with the upper small element fitted in the small portion of the hole and the lower large element fitted in the recess, and the internal surfaces in the front recess and small portion of the hole being operable for producing the turning forces stated.

9. A socket according to claim 8, in combination with, the workpiece, the large and small elements of the workpiece head being fitted in the socket.

10. A socket according to claim 9 wherein, the workpiece has additionally a washer secured to the large element at the lower end of the head, the washer being of greater diametrical dimension than the head, whereby the socket engages the washer when the head is positioned fully in the socket.

11. A socket according to claim 7 wherein, the longitudinal main hole includes a small portion rearwardly of and communicating with the front recess, said adjustable means is constituted by, (a) said small portion of the hole being of polygonal shape, and (b) a key having an external polygonal surface complementary to the small portion of the hole, adjustably secured therein and extendable into the front recess and extendable into engagement with said turning-force receiving surface in the workpiece.

* * * * *